US007508282B2

(12) United States Patent
Kuo et al.

(10) Patent No.: US 7,508,282 B2
(45) Date of Patent: Mar. 24, 2009

(54) COUPLING DEVICE WITH ELECTRO-MAGNETIC COMPENSATION

(75) Inventors: Jen-I Kuo, Chiayii (TW); Jih-Hwa Lee, Taoyuan (TW); Joseph D. S. Deng, Taoyuan (TW)

(73) Assignee: Chung Shan Institute of Science and Technology, Taoyuan County (TW)

( * ) Notice: Subject to any disclaimer, the term of this patent is extended or adjusted under 35 U.S.C. 154(b) by 103 days.

(21) Appl. No.: 11/598,658

(22) Filed: Nov. 14, 2006

(65) Prior Publication Data

US 2008/0111650 A1 May 15, 2008

(51) Int. Cl.
*H01P 5/18* (2006.01)
*H01P 3/08* (2006.01)

(52) U.S. Cl. ..... 333/116; 333/109

(58) Field of Classification Search ..... 333/109, 333/110, 111, 112, 113, 116, 26, 25
See application file for complete search history.

(56) References Cited

U.S. PATENT DOCUMENTS 4,185,258 A * 1/1980 Cote et al. ..... 333/262
5,745,017 A * 4/1998 Ralph ..... 333/116

* cited by examiner

*Primary Examiner*—Dean O Takaoka
(74) *Attorney, Agent, or Firm*—Rosenberg, Klein & Lee

(57) ABSTRACT

A coupling device with electro-magnetic compensation is provided. The coupling device includes a first substrate having a first signal line on a top surface of the first substrate and a second substrate having a second signal line on a top surface of the second substrate connected together with a bottom surface of the first substrate wherein the second signal line couples with the first signal line by a plurality of electrical-conductive through holes. One side of the first signal line lies a capacitor device parallel connected to a ground and the capacitor device plays the role of adjusting the amount of return loss, isolation capacity, and coupling effect so as to have transmitting speeds in first and second signal lines remain substantially the same and superior high frequency characteristics.

19 Claims, 11 Drawing Sheets

COUPLING DEVICE WITH ELECTRO-MAGNETIC COMPENSATION

BACKGROUND OF THE INVENTION

Background

1. Field of the Invention

The present invention relates to a coupling device, and more particularly, to a coupling device with electro-magnetic compensation with the use of a parallel-connected capacitor device to the ground for adjusting the amount of return loss and isolation and getting the amount of coupling effect and output to a level as expected in order to obtain a better high frequency characteristic.

2. Description of the Prior Art

Please refer to FIG. 10 where a prior art broadside coupler 5 includes an upper layer signal line 51 and a lower layer signal line 52 attached to substrates 53 and 54, respectively. The upper signal line 51 couples with the lower signal line 52 by a plurality of electrical conductive through holes 55. A medium layer (substrate) 53 is between the upper layer signal line 51 and the lower layer signal line 52. The prior art coupling device 5 further includes an input end 56, a coupling end 57, an output end 58, and an isolation end 59. FIG. 8A shows the result after having above mentioned ends measured and is indicative of inferior amount of return loss and isolation capacity with the amount of coupling effect and outputting not reaching to a level as anticipated.

The amount of coupling effect, return loss, and isolation capacity depend on the line width of the upper layer signal line 51 and the lower layer signal line 52 and the thickness of the medium layer between the upper layer signal line 51 and the lower layer signal line 52. For the sake of obtaining better return loss and isolation capacity, the change to the line width of the upper layer signal line 51 and the lower layer signal line 52 or the thickness of the medium layer between the upper layer signal line 51 and the lower layer signal line 52 is inevitable, which is not preferred here.

Furthermore, the coupling device 5 couples the signal of the upper layer signal line 51 with that of its lower layer counterpart 52 through the medium layer between 51 and 52 and as the result odd/even mode problems would arise and the transmitting speeds of signals in the upper layer signal line 51 and the lower layer signal line 52 are different, leading to the inferior high frequency characteristic.

SUMMARY OF THE INVENTION

It is therefore a primary objective of the present invention to provide a coupling device with electro-magnetic compensation. With the use of a parallel-connected capacitor device, the present coupling device adjusts the amount of return loss and isolation capacity and makes the amount of coupling and output to reach to a level as anticipated. Furthermore, the present coupling device renders the consistency of signal transmitting speeds in two signal lines possible, achieving the goal of better high frequency characteristics.

In accordance with the claimed invention, a coupling device with electro-magnetic compensation includes a first substrate having a first signal line on a top surface of the first substrate, and a second substrate having a second signal line on a top surface of the second substrate connected together with a bottom surface of the first substrate wherein the second signal line is coupled with the first signal line by a plurality of electrical-conductive through holes, and one side of the first signal line lies a capacitor device parallel connected to a ground. The parallel-connected capacitor device could be either an open stub, a plurality of open stubs connected with others through wire bonding or ribbon bonding, or in the form of getting at least one capacitor connected to a grounded open stub.

It is an advantage of the present invention that with the setting of a parallel-connected capacitor device on one side or both sides of the signal line the present coupling device could have a superior isolation capacity and cut down the return loss while staying the coupling effect and amount of output at a level as expected and rendering the consistency of transmitting speeds in two signal lines possible in order to obtain a better high frequency characteristic.

These and other objectives of the present invention will no doubt become obvious to those of ordinary skill in the art after reading the following detailed description of the preferred embodiment that is illustrated in the various figures and drawings.

DETAILED DESCRIPTION OF THE PREFERRED EMBODIMENT

Figure 1:
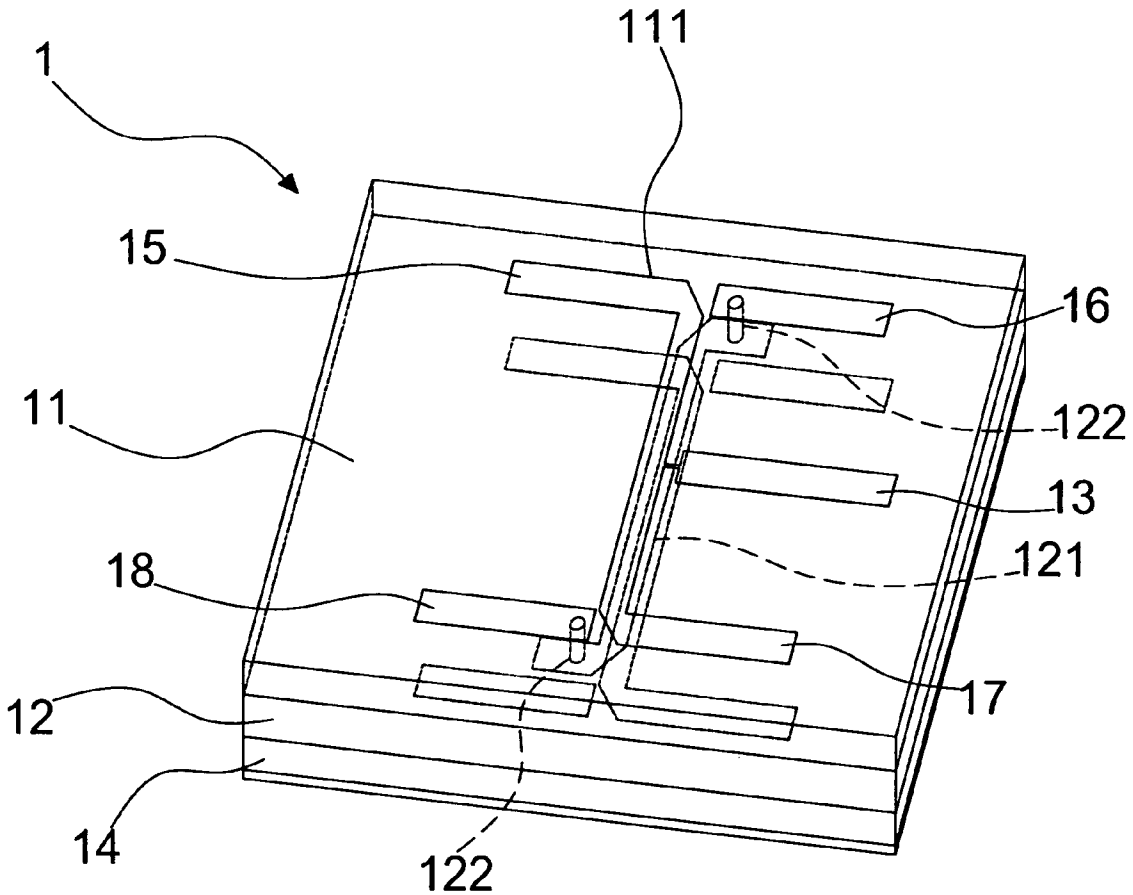
FIG. 1 is a schematic diagram of a coupling device according to the present invention.

Please refer to FIG. 1 of a schematic diagram showing a coupling device 1 according to the present invention. The coupling device 1 includes a first substrate 11 having a first signal line 111 thereon, a second substrate 12 having a second signal 121 thereon, and a parallel-connected capacitor device 13. The first signal line 111 is on the top surface of the first substrate 11 and the bottom surface of the first substrate 11 attaches to the top surface of the second substrate 12 where lies the second signal line 121. The second signal line 121 couples with the first signal line 111 by a plurality of through holes 122 and the parallel-connected capacitor device 13 is placed beside the first signal line 111. The bottom surface of the second substrate 12 further connects to a multi-layer substrate 14 where other layout could be placed. The parallel-connected capacitor device 13 could be either an open stub, in the form of a plurality of open stubs connected with others by wire bonding or ribbon bonding, or a grounded capacitor device.

The first signal line 111 has four ends including an input end 15, a coupling end 16, an output end 17, and an isolation end 18. The coupling device according to the present invention 1 could get the amount of coupling effect, return loss, and the isolation capacity by measuring aforementioned four ends of the first signal line 111. The amount of the coupling effect, return loss, and isolation capacity depend on the length width of first and second signal lines 111 and 121, the thickness of medium layer between those two signal lines 111 and 121 (i.e., the thickness of the first substrate 11), and the parallel-connected capacitor device 13 and the area thereof.

Figure 2:
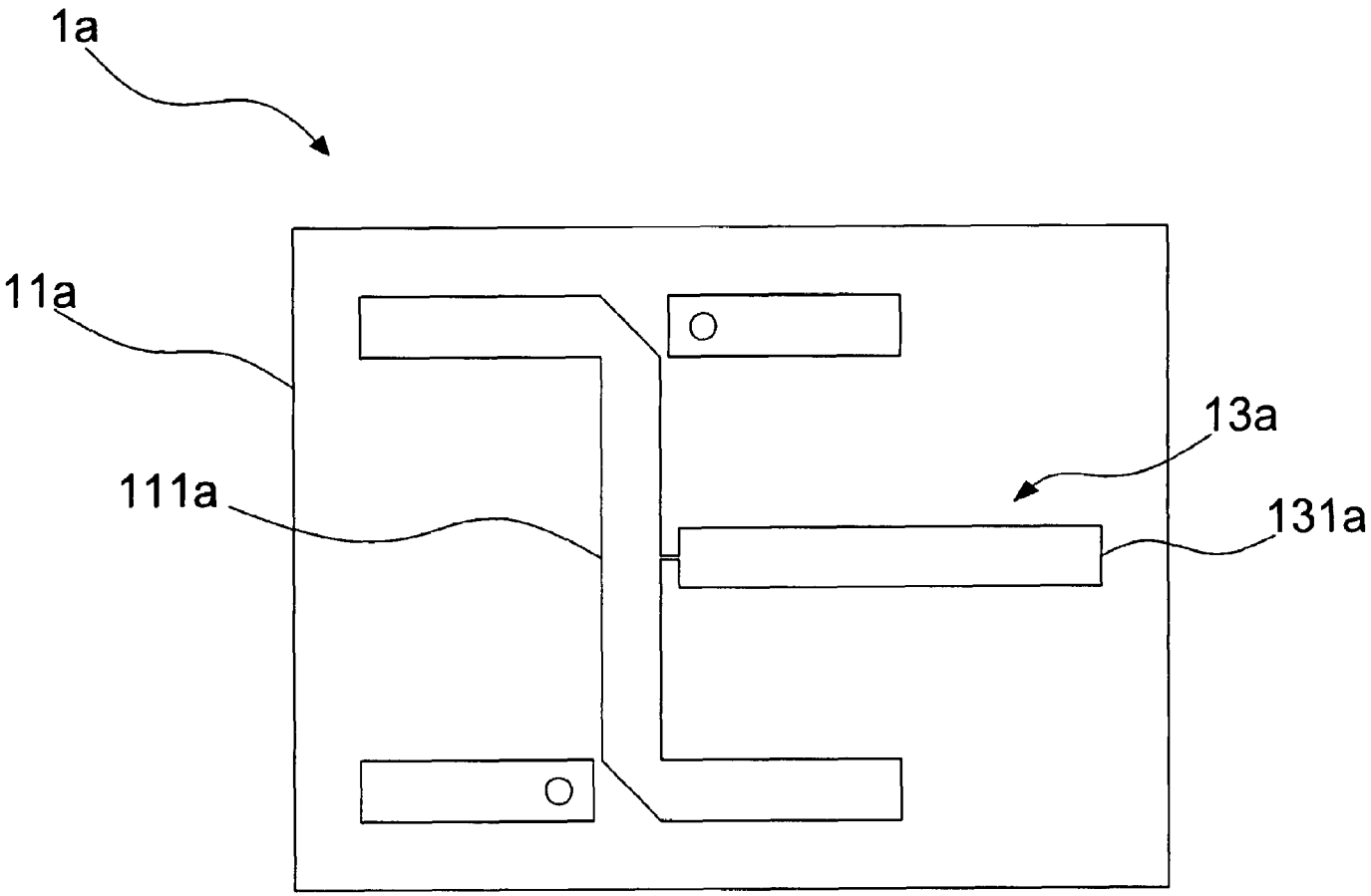
FIG. 2 is a top view of a first preferred embodiment according to the present invention.

Please refer to FIG. 2 of a structure schematic diagram of the first preferred embodiment according to the present invention. A coupling device 1*a* includes a first substrate 11*a* having a first signal line 111*a*, a second substrate 12*a* (refer to FIG. 1) connected to the first substrate 11*a* and having a second signal line 121*a* (refer to FIG. 1 also), and a parallel-connected capacitor device 13*a* beside the first signal line 111*a*. The current preferred embodiment employs an open stub 131*a* as the parallel-connected capacitor device 13*a* and the area of the open stub affects the amount of the coupling effect, return loss, and the isolation capacity of the coupling device 1*a*. However, the use of an open stub as the parallel-connected capacitor device makes the change to the area of the open stub inconvenient where another new open stub must be replaced in order to make changes to the area of the open stub, leading to some inconvenience.

Figure 3:
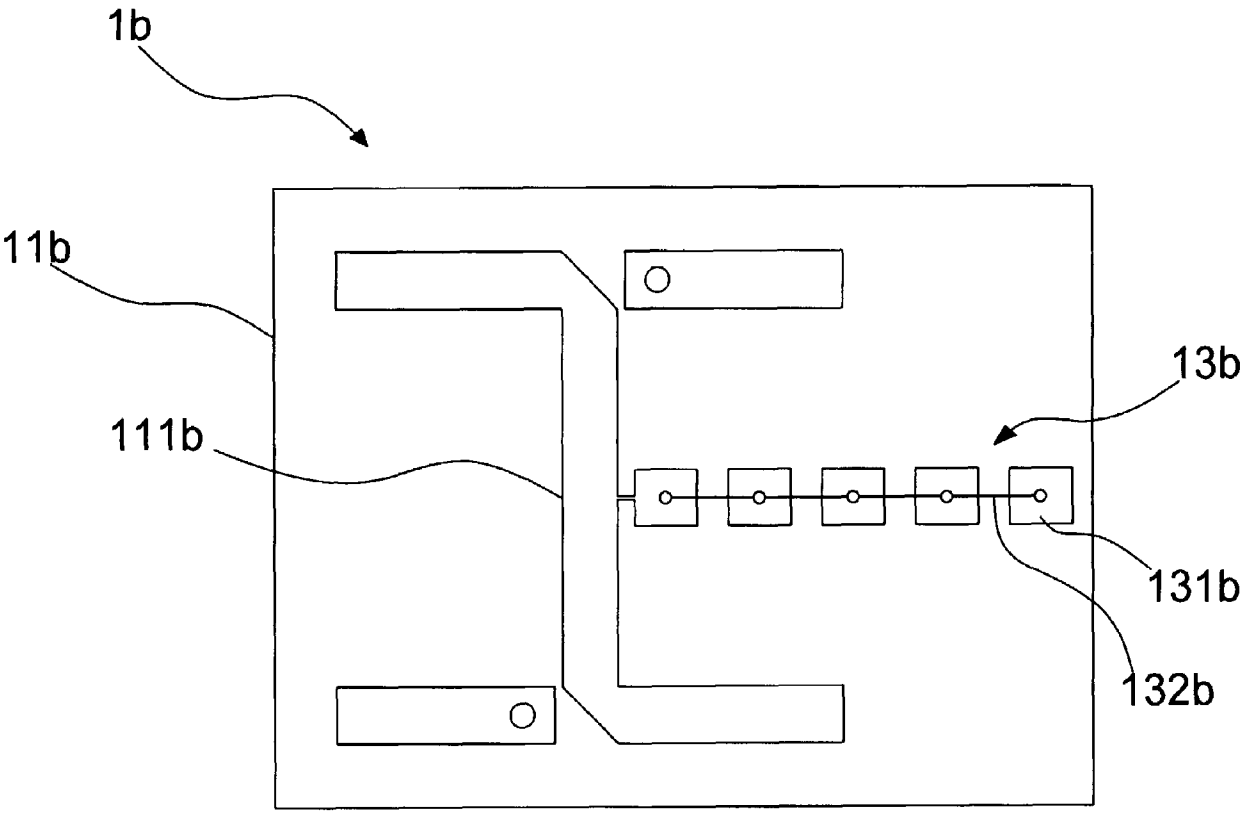
FIG. 3 is a top view of a second preferred embodiment according to the present invention.

Please refer to FIG. 3 of a top view of the second preferred embodiment according to the present invention. A coupling device 1*b* includes a first substrate 11*b* having a first signal line 111*b*, a second substrate attached to the first substrate and having a second signal line (refer to FIG. 1), and a parallel-connected capacitor device to the ground 13*b* beside the first signal line 111*b*. In the current embodiment, the parallel-connected capacitor device to the ground 13*b* is in the form of a plurality of open stubs 131*b* interconnected with others through wire bonding or ribbon bonding, making the area of the parallel-connected capacitor device to the ground 13*b* adjustable without changing the entire open stub.

Figure 4:
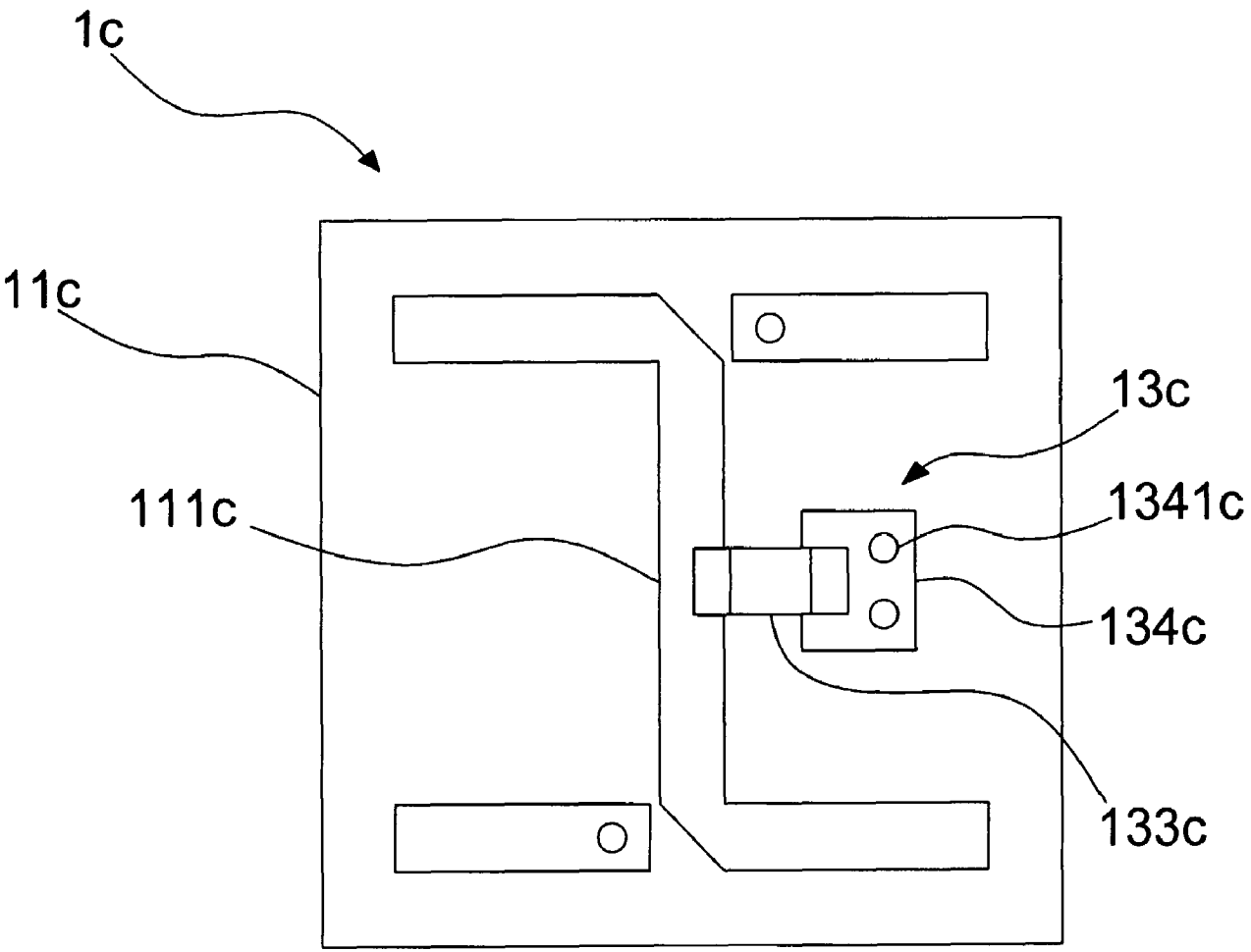
FIG. 4 is a top view of a third preferred embodiment according to the present invention.

Please refer to FIG. 4 of a top view of a third preferred embodiment according to the present invention. A coupling device 1*c* includes a first substrate 11*c* having a first signal line 111*c*, a second substrate attached to the first substrate and having a second signal line (refer to FIG. 1), and a parallel-connected capacitor device to the ground 13*c* beside the first signal line 111*c*. The parallel-connected capacitor device to the ground 13*c* in the this preferred embodiment is in the form of having at least one capacitor 133*c* with one end attached to one side of the first signal line 111*c* and the other end connected to a grounded open stub 134*c*. The grounded open stub 134*c* has at least one through hole 1341*c* for the purpose of grounding. The coupling device 1*c* adjusts the value of the capacitor 133*c* so as to control the amount of the coupling effect, return loss, and isolation capacity of the coupling device 1*c* itself.

Figure 5:
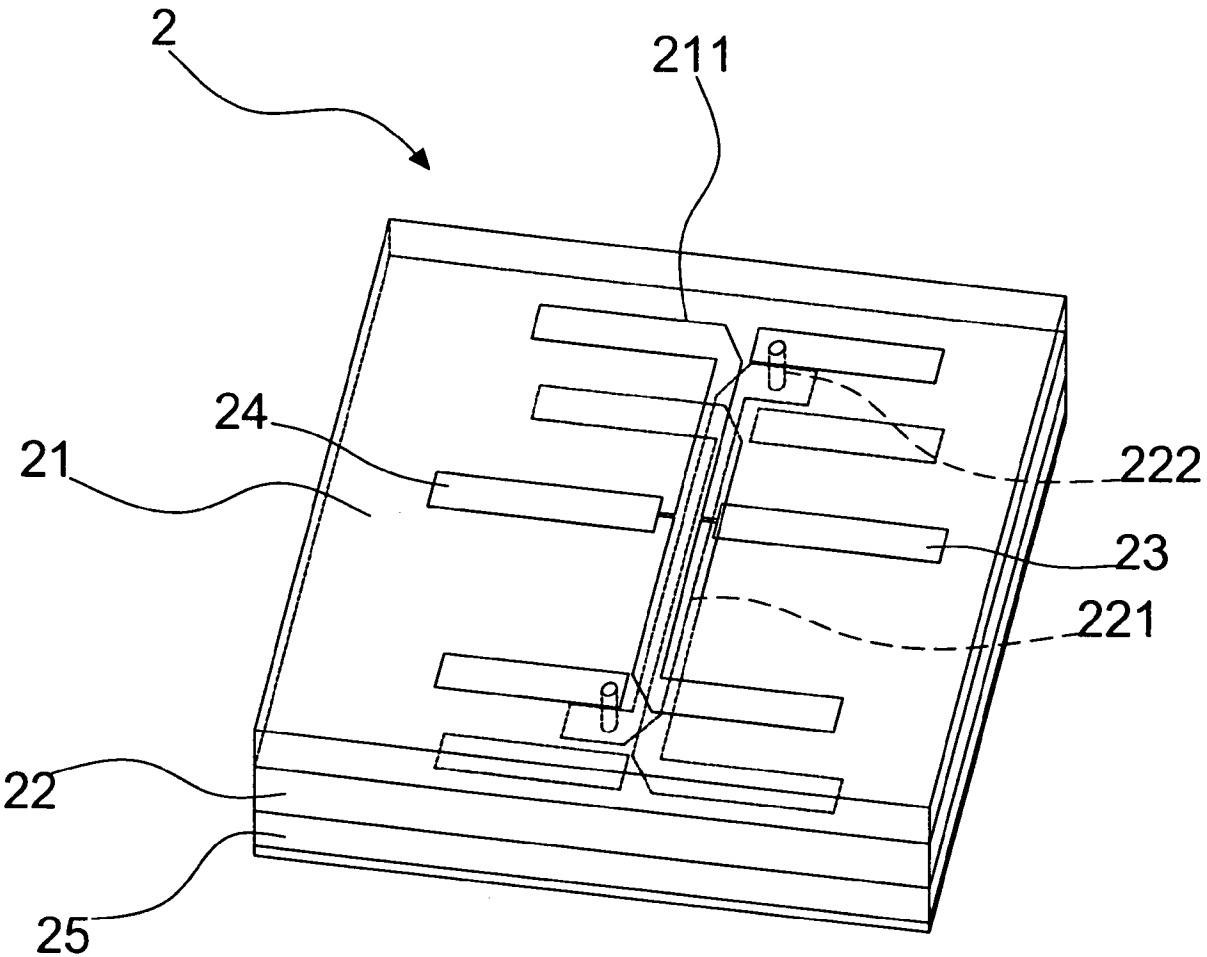
FIG. 5 is another schematic diagram of a coupling device according to the present invention.

Please refer to FIG. 5 of another schematic diagram of a coupling device according to the present invention. A coupling device 2 includes a first substrate 21 having a first signal line 211, a second substrate 22 having a second signal line 221, a first parallel-connected capacitor device 23, and a second parallel-connected capacitor device 24. The bottom surface of the first substrate 21 connects to the top surface of the second substrate 22. The second signal line 221 couples with the first signal line by a plurality of through holes 222. The first parallel-connected capacitor device 23 and the second parallel-connected capacitor device 24 serving as the counterpart of the first parallel-connected capacitor device 23 in terms of the placement lie on each side of the first signal line 211, respectively. The bottom surface of the second substrate 22 connects to a multi-layer substrate 25 where other circuitry layout is placed. The first and second parallel-connected capacitor devices 23 and 24 both could be open stubs, a plurality of open stubs interconnected with others by wire bonding or ribbon bonding, or in the form of having at least one capacitor connected to a grounded open stub.

Figure 6:
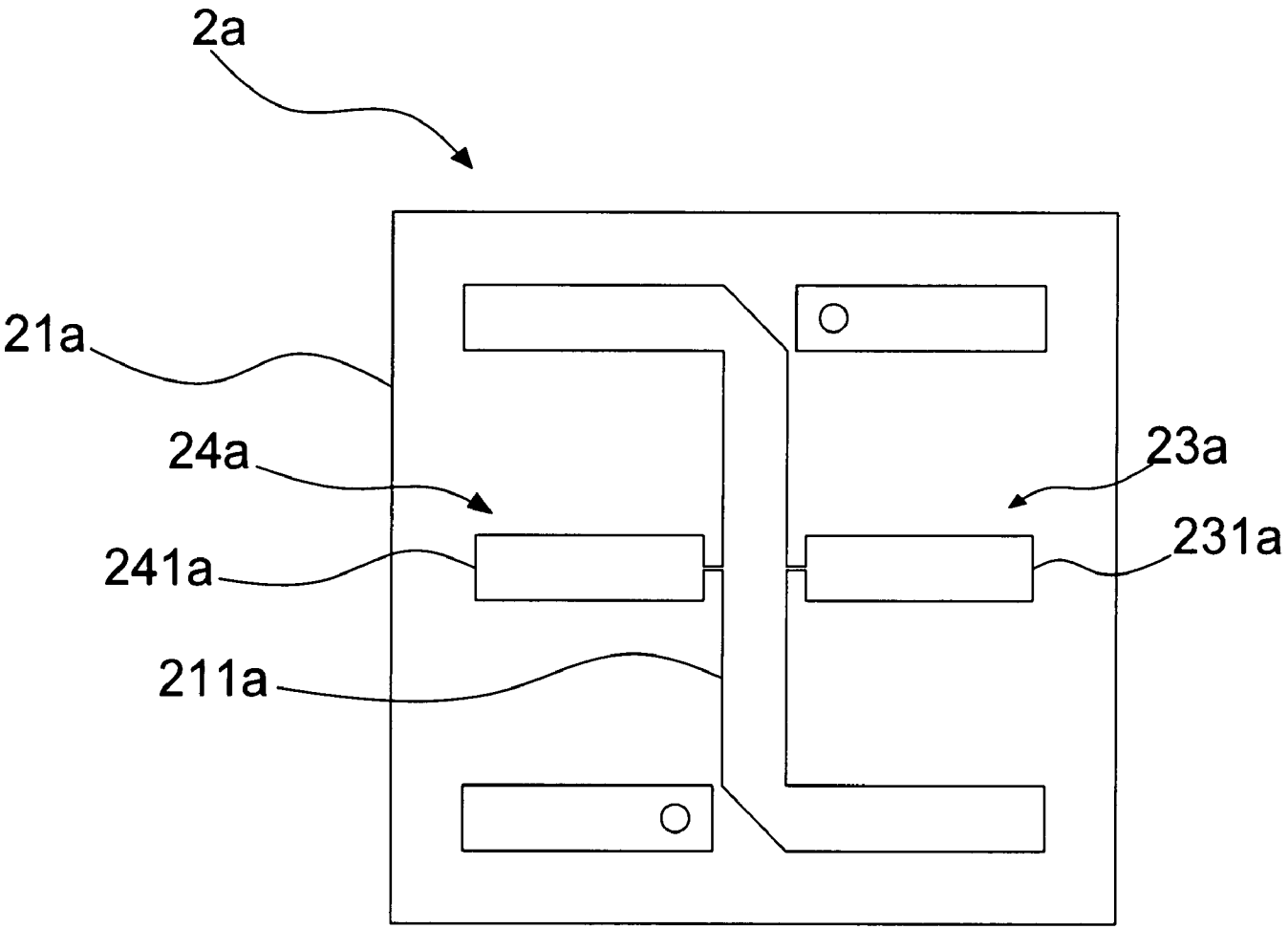
FIG. 6 is a top view of a fourth preferred embodiment according to the present invention.

Please refer to FIG. 6 of a top view of a fourth preferred embodiment according to the present invention. A coupling device 2*a* includes a first substrate 21*a* having a first signal line 211*a*, a second substrate having a second signal line (refer to FIG. 5), a first parallel-connected capacitor device 23*a*, and a second parallel-connected capacitor device 24*a* on each side of the first signal line 211*a*. In the current embodiment, the first and second parallel-connected capacitor devices 23*a* and 24*a* are open stubs 231*a* and 241*a*, respectively, in order to save more space than the embodiment shown in FIG. 2. In FIG. 2, in the case that the open stub 131*a* takes more space the space of the whole coupling device 1*a* increases as the result. The present embodiment divides the open stub 131*a* in FIG. 2 into two pieces of open stubs 231*a* and 241*a* placed on each side of the first signal line 211*a*, for the purpose of limiting the size of the entire coupling device 2*a*.

Figure 7:
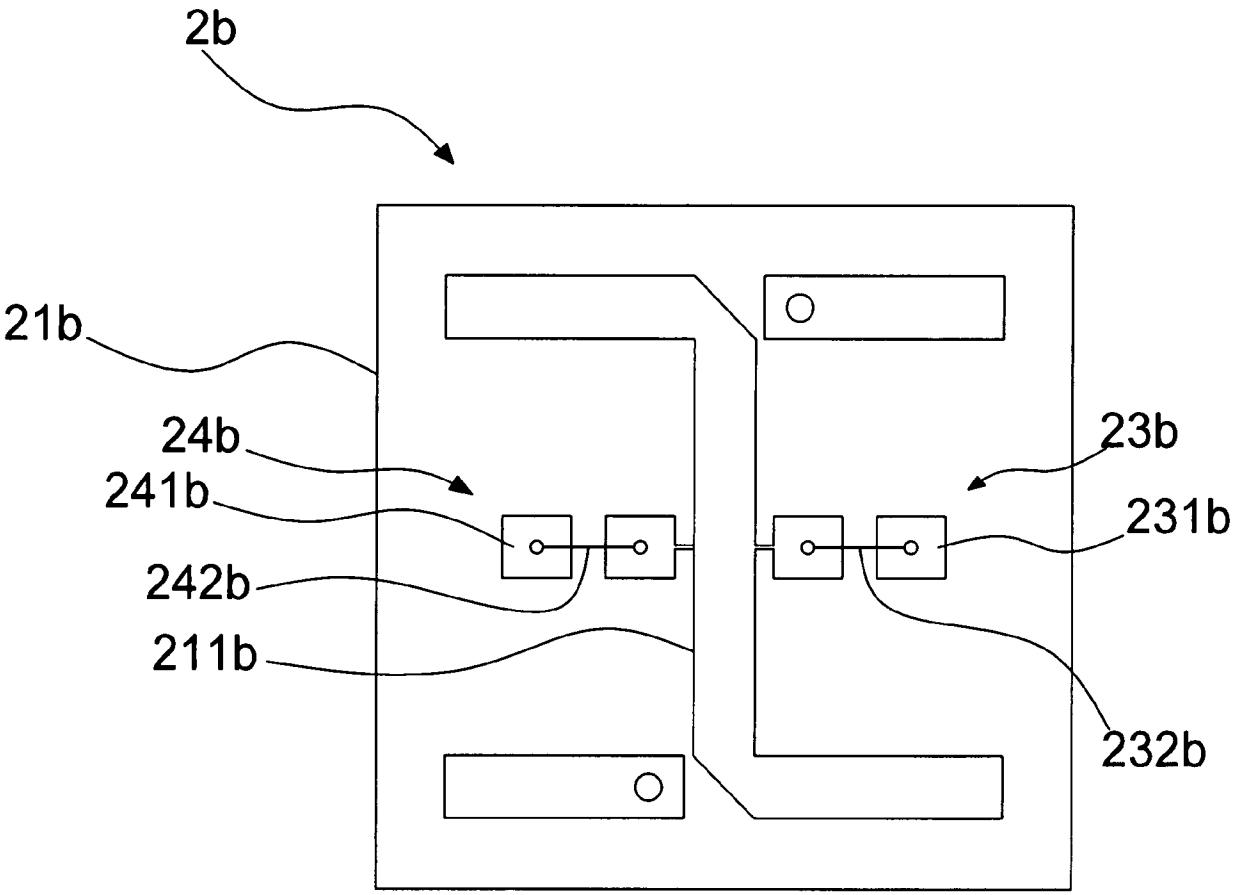
FIG. 7 is a top view of a fifth preferred embodiment according to the present invention.

Please refer to FIG. 7 of a top view of a fifth preferred embodiment according to the present invention. A coupling device 2*b* includes a first substrate 21*b* having a first signal line 211*b*, a second substrate connected to the first substrate 21*b* and having a second signal line (refer to FIG. 5), and a first parallel-connected capacitor device 23*b* and a second parallel-connected capacitor device 24*b* placed on each side of the first signal line 211*b*, respectively. The first and second parallel-connected capacitor devices 23*b* and 24*b* are a plurality of open stubs 231*b* and 241*b*, respectively. Those open stubs 231*b* and 241*b* are interconnected with others through wire bonding or ribbon bonding. In doing so, at the time of adjusting the area of the first and second parallel-connected capacitor devices 23*b* and 24*b* only cutting down the number of those open stubs 231*b* and 241*b* is required, providing a viable alternative to the fourth preferred embodiment according to the present invention shown in FIG. 5.

Figure 8:
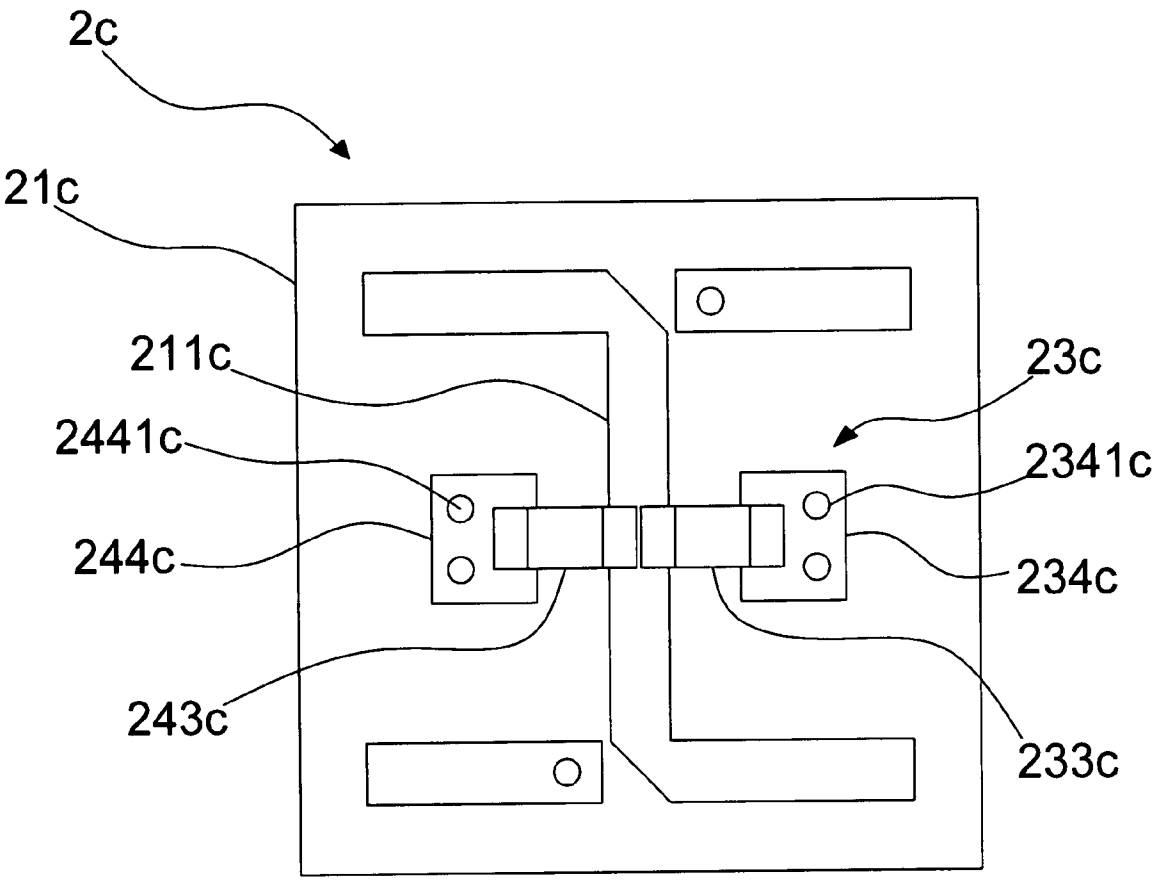
FIG. 8 is a top view of a sixth preferred embodiment according to the present invention.

Please refer to FIG. 8 of a top view of a sixth preferred embodiment according to the present invention. A coupling device 2*c* includes a first substrate 21*c* having a first signal line 211*c*, a second substrate connected to the first substrate 21*c* and having a second signal line (refer to FIG. 5), and a first parallel-connected capacitor device 23*c* and a second parallel-connected capacitor device 24*c* placed on each side of the first signal line 211*b*, respectively. The first and second parallel-connected capacitor devices 23*c* and 24*c* are single capacitors 233*c* and 243*c* connected to grounded open stubs 234*c* and 244*c*. One end of each of capacitors 233*c* and 243*c* connects to the first signal line 211*c* while the other end of those capacitors 233*c* and 243*c* connects to grounded open stubs 234*c* and 244*c*. Those grounded open stubs 233*c* and 244*c* each has at lest one through hole 2341*c* and 2441*c* connected to the ground. The present preferred embodiment controls the value of capacitors 233*c* and 243*c* for controlling the coupling effect, the return loss, and the isolation capacity thereof.

Figure 9A:
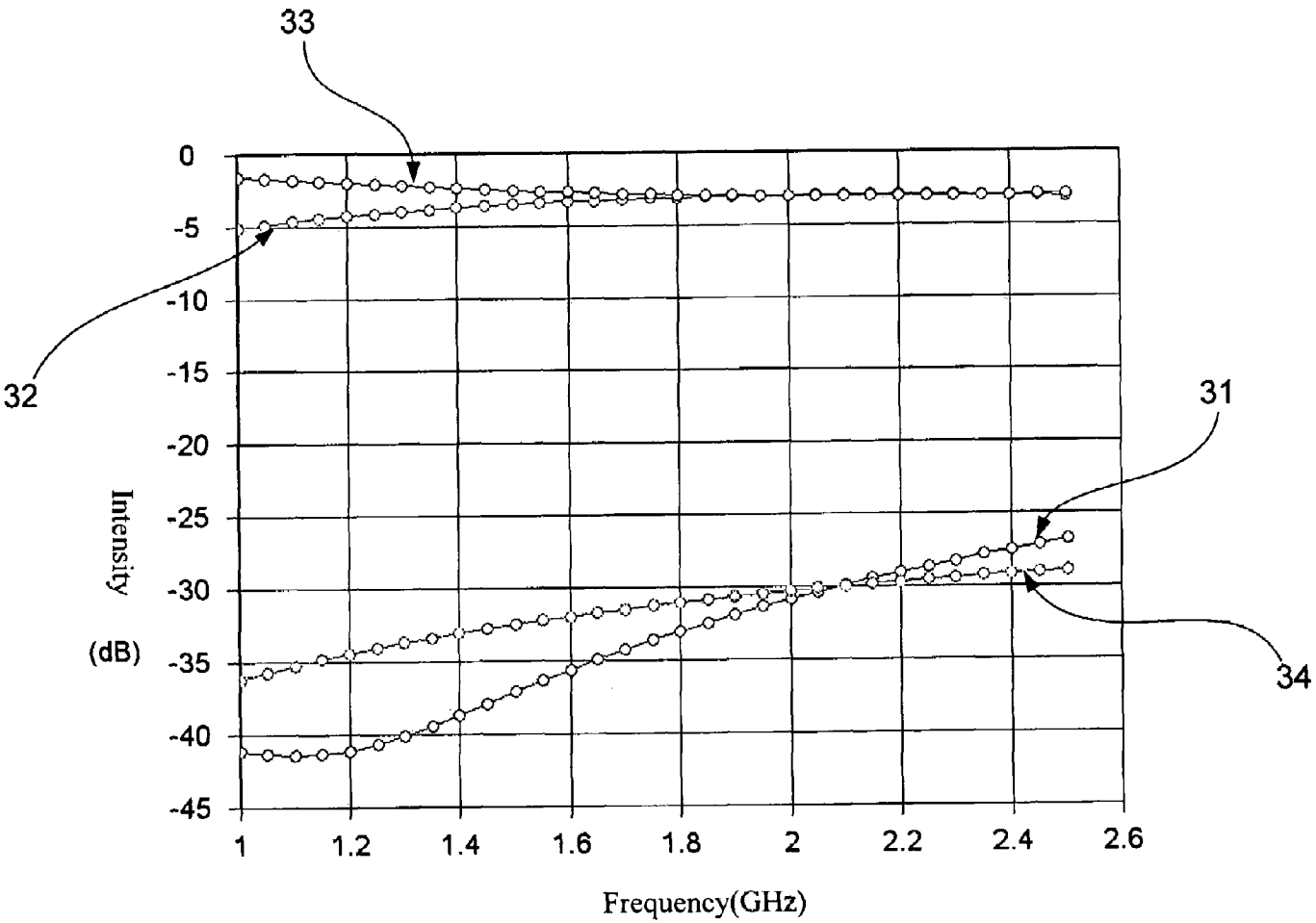
FIG. 9A is a curve of the S-parameter of a coupling device according to the present invention.
Figure 9B:
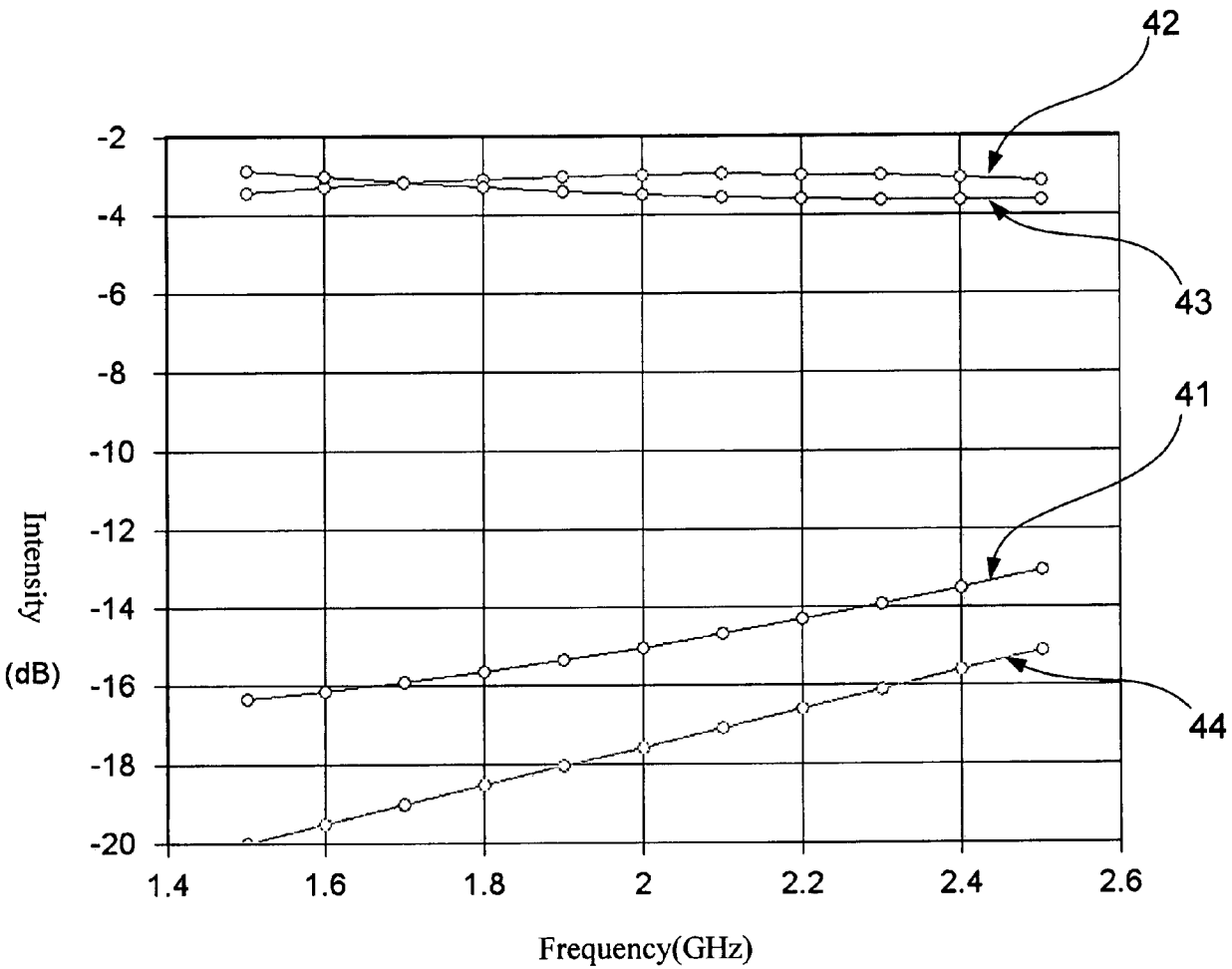
Fig. 9B (Prior Art)
FIG. 9B is a curve of the S-parameter of a coupling device according to the prior art.
Figure 10:
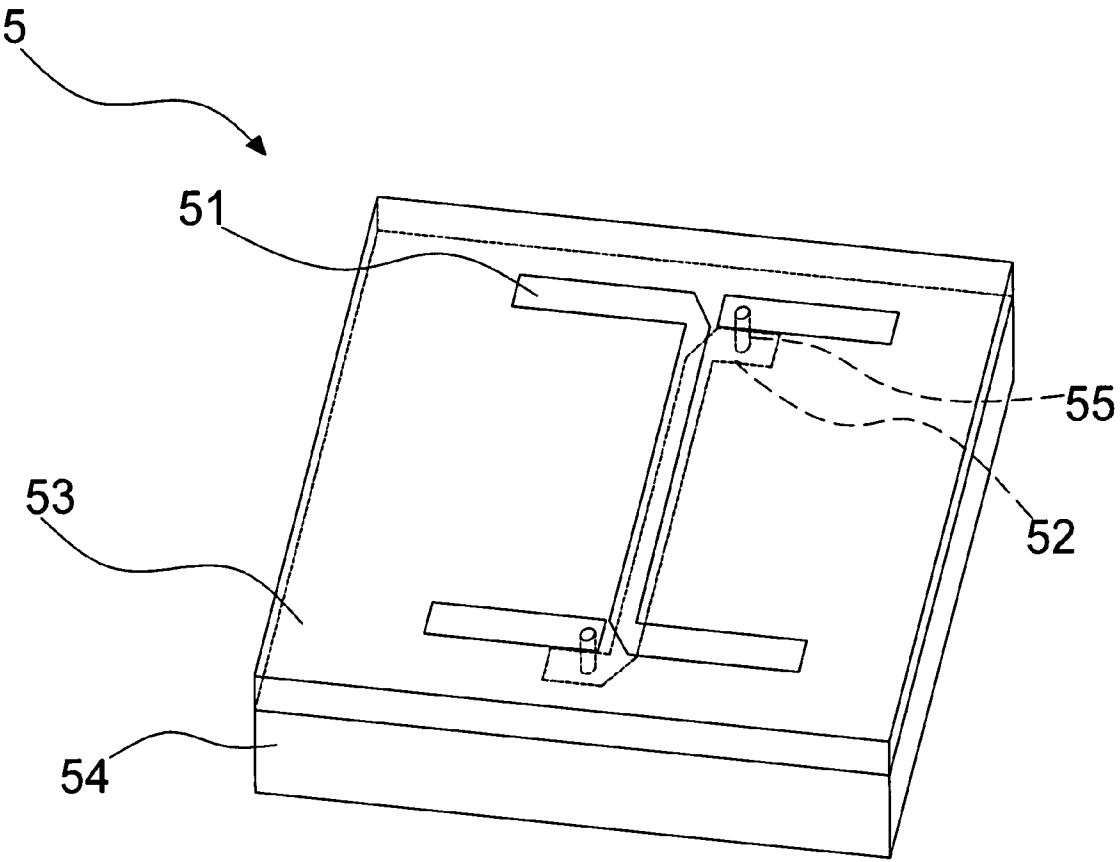
Fig. 10 (Prior Art)
FIG. 10 is a schematic diagram of a coupling device according to the prior art.

Please refer to FIGS. 9A and 9B of schematic diagrams showing S-parameter curves of coupling devices according to the present invention and prior art, respectively. Both coupling devices have in put end, a coupling end, an output end, and an isolation end. The coupling device according to the present invention has a first, second, third, and fourth curves

31, 32, 33, and 34 while its counterpart based on the prior art is with fifth, sixth, seventh, and eighth curves 41, 42, 43, and 44.

The second and third curves are from the coupling and output ends of the coupling device according to the present invention. From those two curves, the amount of coupling effect and output is substantially equal at the frequency of 2 GHz while their counterparts (the sixth and seventh curves 42 and 43 from coupling and output ends of the coupling device of the prior art) are not close to each other at the same 2 GHz frequency, failing to meet the goal of having the amount of the coupling effect and output substantially equal.

The first and fifth curves show inputs of coupling devices according to the present invention and prior art. At the frequency of 2 GHz, the return loss for the coupling device according to the present invention is minus 32 db but is minus 15 db in the case of the coupling device based on the prior art. As the result, the present coupling device does improve the return loss.

The fourth and eighth curves 34 and 44 come from isolation ends of coupling devices according to the present invention and prior art, respectively. At the frequency of 2 GHz, the amount of isolation capacity is minus 31 db in the coupling device according to the present invention while the coupling device according to the prior art has the isolation capacity stay at minus 17.5 db. Above two curves show the difference in the isolation capacity between the coupling device according to the prior art and present invention, which effectively improve the performance of the isolation capacity.

In contrast to prior art coupling device, the coupling device according to the present invention incorporates a parallel-connected capacitor device to the ground for improving the return loss and isolation capacity and making the coupling effect and the amount of output reach to a level as expected. With the aforementioned characteristic, the present invention makes transmitting speeds in the first and second signal lines remain substantially the same so as to achieve better high frequency characteristics.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A unitary coupling device with electro-magnetic compensation, comprising:

a first substrate having a first signal line on a top surface of the first substrate; said first signal line comprising an input end, coupling end, output end, and isolation end;

a second substrate having a second signal line on a top surface of the second substrate connected together with a bottom surface of the first substrate; wherein the second signal line couples with the first signal line by a plurality of electrically conductive through holes; and a capacitor device connected electrically in parallel to a ground and connected on one side of the first signal line.

2. The unitary coupling device with electro-magnetic compensation in claim 1, wherein the bottom surface of the second substrate connects to a multi-layer substrate and the first and second layers of the multi-layer substrate, includes an individual circuit layout.

3. The unitary coupling device with electro-magnetic compensation in claim 1, wherein the capacitor device is an open stub.

4. The unitary coupling device with electro-magnetic compensation in claim 1, wherein the capacitor device is in the form of a plurality of open stubs connected each with the other through wire bonding.

5. The unitary coupling device with electro-magnetic compensation in claim 1, wherein the capacitor device is in the form of a plurality of open stubs connected each with the other through ribbon bonding.

6. The unitary coupling device with electro-magnetic compensation in claim 1, wherein the capacitor device comprises at least one capacitor electrically connected to an electrically grounded open stub.

7. The unitary coupling device with electro-magnetic compensation in claim 6, wherein the electrically grounded open stub includes at least one through hole electrically connected to the ground.

8. A unitary coupling device with electro-magnetic compensation, comprising:

a first substrate having a first signal line on a top surface of the first substrate; said first signal line comprising an input end, coupling end, output end, and isolation end;

a second substrate having a second signal line on a top surface of the second substrate connected together with a bottom surface of the first substrate wherein the second signal line is coupled in the form of a plurality of electrical-conductive through holes; and a first capacitor device connected electrically in parallel to a ground, and a second capacitor device connected electrically in parallel to the ground, said first and second capacitor devices connected to the first signal line on opposite sides of the first signal line.

9. The unitary coupling device with electro-magnetic compensation in claim 8, wherein the bottom surface of the second substrate connects to a multi-layer substrate and the first and second layers of the multi-layer substrate includes an individual circuit layout is with a circuitry layout individually.

10. The unitary coupling device with electro-magnetic compensation in claim 8, wherein the first capacitor device is an open stub.

11. The unitary coupling device with electro-magnetic compensation in claim 8, wherein the second capacitor device is an open stub.

12. The unitary coupling device with electro-magnetic compensation in claim 8, wherein the first capacitor device comprises at least one capacitor electrically connected to a grounded open stub.

13. The unitary coupling device with electro-magnetic compensation in claim 12, wherein the grounded open stub includes at least one through hole electrically connected to the ground.

14. The unitary coupling device with electro-magnetic compensation in claim 8, wherein the second capacitor device comprises at least one capacitor electrically connected to a grounded open stub.

15. The unitary coupling device with electro-magnetic compensation in claim 14, wherein the grounded open stub includes at least one through hole electrically connected to the ground.

16. The unitary coupling device with electro-magnetic compensation in claim 8, wherein the first capacitor device is in the form of a plurality of open stubs connected each with the other through wire bonding.

17. The unitary coupling device with electro-magnetic compensation in claim 8, wherein the first capacitor device is in the form of a plurality open stubs connected each with the other through ribbon bonding.

18. The unitary coupling device with electro-magnetic compensation in claim 8, wherein the second capacitor device is in the form of a plurality of open stubs connected each with the other through wire bonding.

19. The unitary coupling device with electro-magnetic compensation in claim 8, wherein the second capacitor device is in the form of a plurality of open stubs connected each with the other through ribbon bonding.

* * * * *